US006002370A

United States Patent [19]

Mckinnon et al.

[11] Patent Number: 6,002,370

[45] Date of Patent: Dec. 14, 1999

[54] ANTENNA ARRANGEMENT

[75] Inventors: John Peter Bruce Mckinnon, Paignton; Andrew Barrington Clayton, Torquay; John Eric Barrett, Brixham, all of United Kingdom

[73] Assignee: Northern Telecom Limited, Montreal, Canada

[21] Appl. No.: 09/131,957

[22] Filed: Aug. 11, 1998

[51] Int. Cl.[6] ..... H01Q 1/38; H01Q 1/50

[52] U.S. Cl. ..... 343/700 MS; 343/767; 343/876; 343/853

[58] Field of Search ..... 343/700 MS, 767, 343/770, 810, 768, 769, 814, 816, 820, 850, 853, 876; H01Q 1/38, 1/50

[56] References Cited

U.S. PATENT DOCUMENTS

| | | | |
|---|---|---|---|
| 5,001,492 | 3/1991 | Shapiro et al. | 343/700 MS |
| 5,554,995 | 9/1996 | Jun | 343/700 MS |
| 5,598,168 | 1/1997 | Evans et al. | 343/700 MS |
| 5,892,487 | 4/1999 | Fujimoto et al. | 343/767 |

*Primary Examiner*—Hoanganh Le
*Attorney, Agent, or Firm*—Lee, Mann, Smith, McWilliams, Sweeney & Ohlson

[57] ABSTRACT

A radio frequency antenna arrangement for selective operation at orthogonal polarizations of electromagnetic radiation. The antenna arrangement comprises at least one radiating element, such as one or more antenna patches, each having a vertical polarization feed point and a horizontal polarization feed point. The arrangement also includes a vertical feeder circuit for coupling a radio frequency modulated electromagnetic signal to the vertical polarization feed point of the or each radiating element, a horizontal feeder circuit for coupling a radio frequency modulated electromagnetic signal to the horizontal polarization feed point of the or each radiating element and a terminating resistive load. A switch mechanism is provided for selectively coupling the electromagnetic signal to one of the horizontal feeder circuit or the vertical feeder circuit and for selectively coupling the load to the other of the horizontal feeder circuit or the vertical feeder circuit. In the first position of the switch the electromagnetic signal is coupled to the horizontal feeder circuit and the resistive load is coupled to the vertical feeder circuit and the antenna arrangement operates predominantly in the horizontal polarization. In the second position of the switch the electromagnetic signal is coupled to the vertical feeder circuit and the resistive load is coupled to the horizontal feeder circuit and the antenna arrangement operates predominantly in the vertical polarization. In a first embodiments of the invention the switch mechanism is located at the interface between two antenna housing parts and the required polarization is selected by mechanical alignment of the housing parts relative to each other. In a second embodiment of the invention the switch mechanism is integrated onto the feeder circuits.

16 Claims, 3 Drawing Sheets

ANTENNA ARRANGEMENT

FIELD OF THE INVENTION

This invention relates to an antenna arrangement, in particular an antenna arrangement for use in a radio transceiver of a fixed wireless access telecommunications network using oppositely polarised orthogonal frequency channels.

Known fixed wireless access telecommunications networks comprise radio transceivers which are located at subscriber's premises. The radio transceivers at the subscribers premises communicate by radio link with a base station, which provides cellular radio coverage over, for example, a 5 km radius in urban environments. A typical base station will support 500–2000 subscribers. Each base station is connected to a standard PSTN switch via a conventional transmission link. Thus subscribers are connected to a national telecommunications network by radio link using a wireless telecommunication network in place of the more traditional method of copper cable.

Subscriber's to the network will have an antenna arrangement mounted in an elevated position on the outside of their premises. Before the antenna is installed at a user's premises an optimal direction for the antenna arrangement is identified using monitoring equipment. When the antenna is installed it is then directed towards the nearest (or best strength) base station or repeater antenna arrangement.

When a fixed wireless access telecommunication network is initially deployed, then a base station of a suitable capability to provide the anticipated required coverage will be installed to cover a particular populated area. In order to meet the capacity demand, within an available frequency band allocation, fixed wireless access systems divide a geographical area into cells. Within each cell is a base station through which subscriber's transceivers located within that cell communicate. The layout of the cells or frequency plan is designed to provide acceptable levels of co-channel interference with the minimum number of base stations, in order to reduce deployment and maintenance costs.

Generally, a frequency plan will allocate a subset of all the available frequency channels in the frequency band allocation of the network to each cell of the plan. To increase the capacity of the cell, each frequency channel is generally subdivided into a number of sub-channels, for example, by time division or code division.

A further way to increase the capacity of a frequency plan is to use the polarisation of the radio frequency (RF) electromagnetic radiation. Antennas are usually polarisation sensitive and so will predominantly receive or transmit either horizontally or vertically polarised RF radiation. Polarisation can be used in frequency planning to increase capacity and/or reduce co-channel interference levels by having a system in which some channels comprise vertically polarised RF radiation and some channels comprise horizontally polarised RF radiation. Then base stations can be arranged so that some are suitable for predominantly transmitting and receiving vertically polarised RF radiation and others are suitable for predominantly transmitting and receiving horizontally polarised RF radiation. Alternatively, each base station can have one or more antennas for predominantly transmitting and receiving vertically polarised RF radiation and one or more antennas for predominantly transmitting and receiving horizontally polarised RF radiation, depending on the frequency plan.

Where different radiation polarisations are used in a frequency plan it is necessary to provide each subscriber with an antenna arrangement which is suitable for the correct polarisation of RF radiation, depending on the location of the subscriber's premises. When a new subscriber joins the network, a technician will be sent to survey the subscriber's premises to find a suitable location and directional position for the subscriber's antenna. The technician will carry with him/her a signal assessment kit which will include two test antennas (one suitable for transceiving vertically polarised RF radiation and one suitable for transceiving horizontally polarised RF radiation) and a portable computer. The computer will be programmed with information about the polarisation of antenna which should be used at different locations in the network and so will indicate to the technician which polarisation of RF radiation is best for use at a new subscriber's premises. The technician will then attach a test antenna of the appropriate polarity (ie. suitable to receive the correct RF radiation polarisation) to the signal assessment kit. Sometimes the technician can mistakenly attach the wrong antenna to the test kit, leading to an incorrect survey or at least an increased time for conducting the survey. Also, it is cumbersome for the technician to have to carry with him/her two test antennas.

After the survey has been done an installation technician will visit the subscriber's premises to install the antenna and other equipment making up a subscriber unit. The technician will have instructions about which polarity of antenna to install and where to install it. The technician has to take with him/her to the premises the correct polarity antenna, either a horizontal polarity antenna or a vertical polarity antenna, depending on the results of the survey. If the technician does not have a correct type of antenna with him/her, clearly installation efficiency is compromised.

In addition the manufacturer of the subscriber antenna units has to make antennas to two different designs, one providing vertical polarity and one providing horizontal polarity and maintain adequate stocks of both types of antenna, which increases costs.

When a cell has reached its capacity, the base station may be upgraded in order to cope with more subscribers or the cell may be split into, for example, two cells of smaller size. In this case it may be necessary to change at least some of the subscribers in the cell from one polarisation of RF radiation to the other. All the subscriber's who are changed from one polarisation to another will have to have their premises resurveyed and will have to have their antenna changed for one which is suitable for the opposite polarisation. This is an expensive and inefficient way of upgrading the network when capacity is reached in certain regions.

The above problems are less onerous in antennas which comprise an array of patches which are symmetrical about two perpendicular axes, for example an n×n grid arrangement of antenna patches. This is because the antenna array can be switched between different polarities by simply rotating the array through 90° about the point where the two perpendicular axes cross. This can provide an acceptable antenna pattern in both vertical and horizontal polarisations. However, where the array of patches is not symmetrical or is symmetrical about only one axis, the antenna pattern generated by the array of patches is optimised for either vertical or horizontal polarisation.

OBJECT OF THE INVENTION

The present invention seeks to provide a dual polarisation antenna arrangement which overcomes or at least mitigates one or more of the problems noted above.

The present invention further seeks to provide an antenna arrangement which can operate selectively at vertical or horizontal polarisations.

SUMMARY OF THE INVENTION

According to a first aspect of the present invention there is provided a radio frequency antenna arrangement for selective operation at orthogonal polarisations of electromagnetic radiation, comprising;

a first housing for housing;

at least one radiating element each having a vertical polarisation feed point and a horizontal polarisation feed point, a vertical feeder circuit for coupling a radio frequency modulated electromagnetic signal to the vertical polarisation feed point of the or each radiating element, and a horizontal feeder circuit for coupling a radio frequency modulated electromagnetic signal to the horizontal polarisation feed point of the or each radiating element, a second housing for housing;

a terminating resistive load, and a connection to the modulated electromagnetic signal, and a switch mechanism comprising a mechanically selectable electrical connection between the first housing and the second housing for selectively coupling the electromagnetic signal to one of the horizontal feeder circuit or the vertical feeder circuit and for selectively coupling the load to the other of the horizontal feeder circuit or the vertical feeder circuit.

The switch mechanism, in a first mechanically selectable position couples the electromagnetic signal to the horizontal feeder circuit and the resistive load to the vertical feeder circuit. Thus, the electromagnetic signal is coupled to the horizontal feed points of the radiating elements and so is radiated by the radiating elements in a predominantly the horizontal polarisation. The radiating elements are prevented from resonating in the vertical polarisation because the resistive load coupled to the vertical feeder circuit terminates the vertical feeder circuit. Accordingly, when the switch is in this first position the radiating patches are exited predominantly by incoming signals in the horizontal polarisation and so only horizontally polarised signals will be coupled out of the radiating elements.

In a second mechanically selectable position the switch mechanism couples the electromagnetic signal to the vertical feeder lines and the resistive load to the horizontal feeder lines and the antenna arrangement operates predominantly in the vertical polarisation.

This embodiment is more suitable for an antenna arrangement suitable for permanent location at a subscriber's premises and preferably;

the second housing has a first electrical contact coupled to the modulated electromagnetic signal and a second electrical contact connected to the resistive load, and the first housing has a third electrical contact connected to the horizontal feeder circuit and a fourth electrical contact connected to the vertical feeder circuit such that in a first mechanically selectable position of the mechanically selectable electrical connection between the housings the first and third contacts and second and fourth contacts are electrically connected and in a second position of the mechanically selectable electrical connection between the housings the first and fourth contacts and the second and third contacts are electrically connected.

The mechanically selectable electrical connection may be changed by selective alignment of the first and second housings.

Therefore, when an antenna is installed at a subscriber's premises, the installation technician can customise the antenna according to the present invention by connecting the first housing to the second housing in the correct alignment suitable for the required polarisation. Thereafter, if the antenna polarisation has to be altered, for example due to an upgrade of the base station, this can be achieved by simply realigning the first housing and the second housing.

Conveniently, the realignment of the first housing to the second housing requires only a 180° rotation of the first housing relative to the second housing.

Preferably, the second housing contains a modulation circuit for generating the radio frequency modulated electromagnetic signal as an output. The modulation circuit is generally embodied on a printed circuit board.

According to a second aspect of the present invention there is provided a method for switching the polarisation of an antenna arrangement between two orthogonal polarisations, which antenna arrangement comprises;

a first housing for housing;

at least one radiating element each having a vertical polarisation feed point and a horizontal polarisation feed point, a vertical feeder circuit for coupling a radio frequency modulated electromagnetic signal to the vertical polarisation feed point of the or each radiating element, and a horizontal feeder circuit for coupling a radio frequency modulated electromagnetic signal to the horizontal polarisation feed point of the or each radiating element, a second housing for housing;

a terminating resistive load, and a connection to the modulated electromagnetic signal, and said method comprising the steps of;

mechanically selecting an electrical connection between the first housing and the second housing for selectively coupling the electromagnetic signal to one of the horizontal feeder circuit or the vertical feeder circuit and for selectively coupling the load to the other of the horizontal feeder circuit or the vertical feeder circuit Preferably, mechanically selecting an electrical connection between the first and second housing comprises the step of selectively aligning the first and second housings. It is preferred that mechanically selecting an electrical connection between the first and second housing comprises the step of rotating one of the first or second housings relative to the other by 180°.

According to a third aspect of the present invention there is provided a radio frequency antenna arrangement for selective operation at orthogonal polarisations of electromagnetic radiation, comprising;

at least one radiating element each having a vertical polarisation feed point and a horizontal polarisation feed point, a vertical feeder circuit for coupling a radio frequency modulated electromagnetic signal to and from the vertical polarisation feed point of the or each radiating element, a horizontal feeder circuit for coupling a radio frequency modulated electromagnetic signal to and from the horizontal polarisation feed point of the or each radiating element, a terminating resistive load, and a switch mechanism which is integrated into the feeder circuits for selectively coupling the electromagnetic signal to one of the horizontal feeder circuit or the vertical feeder circuit and for selectively coupling the load to the other of the horizontal feeder circuit or the vertical feeder circuit Preferably, the antenna arrangement additionally comprises a modulation circuit for generating the radio frequency modulated electromagnetic signal as an output.

In an exemplary embodiment of the present invention the switch mechanism comprises a four terminal electrical switch, including;

a first terminal coupled to the electromagnetic modulated signal, a second terminal coupled to the resistive load, a third terminal coupled to the horizontal feeder lines, and a fourth terminal coupled to the vertical feeder lines, so that in a first switch position the first terminal is connected to the third terminal and the second terminal is connected to the fourth terminal and in a second switch position the first terminal is connected to the fourth terminal and the second terminal is connected to the third terminal.

In an alternative embodiment the switch mechanism comprises;

a first terminal coupled to the electromagnetic modulated signal, a second terminal coupled to the horizontal feeder circuit, a third terminal coupled to the vertical feeder circuit, and a load switch circuit, so that in a first switch position the first terminal is connected to the second terminal and the third terminal is connected to a terminating resistive load by the load switch circuit and in a second switch position the first terminal is connected to the third terminal and the second terminal is connected to a terminating resistive load by the load switch circuit.

The radiating elements may be microstrip antenna patches. The feeder circuits are formed as a microstrip circuit into which is integrated the switch mechanism. The switch mechanism may comprise a switch which is embodied in a semiconductor chip. The semi-conductor switch may be integrated onto the microstrip circuit by mounting the chip on the microstrip circuit backing material and electrically connecting the chip to the microstrip feeder circuits by microstrip line connections.

The entire antenna arrangement may be housed in a single antenna housing to form a dual polarisation antenna which can be used as a test antenna for conducting surveys of subscriber premises. Thus, one test antenna is suitable for use at premises with network coverage in different orthogonal polariations. Preferably, the antenna arrangement is interfaced with a computing device which operates the switch mechanism automatically. Thus, when a survey technician inputs the subscriber's address into the computing device, the test antenna will automatically be switched to the correct polarisation.

BRIEF DESCRIPTION OF THE DRAWINGS

In order that the present invention is more fully understood and to show how the same may be carried into effect, reference shall now be made, by way of example only, to the figures as shown in the accompanying drawing sheets, wherein;

Referring to FIG. 3 which shows the antenna (40) in cross section. The antenna has a two part clamshell housing (41,42) made of injection moulded plastics material, the bottom half of which (42) supports a reflecting backplate (44). The backplate (44) is formed with four rectangular depressions (46) which correspond to the four microstrip resonant antenna patches (6,7,8,9) shown in FIG. 1, one of which (9) is shown in FIG. 3. Over the backplate (44) is located a layer of dielectric material (47), such as polystyrene which has a dielectric constant close to that of air. The polystyrene layer (47) is formed with four rectangular raised portions (48) which fit into the depressions (46) in the reflecting backplate (44). The polystyrene layer (46,48) insulates the backplate (44) from a microstrip circuit (2) which is shown in FIG. 1 and which comprises a 37 micron thick copper film printed on a thin sheet of plastic material (4). The circuit (2) comprises an array of four rectangular microstrip resonant antenna patches (6,7,8,9) which are driven in phase.

Figure 1:
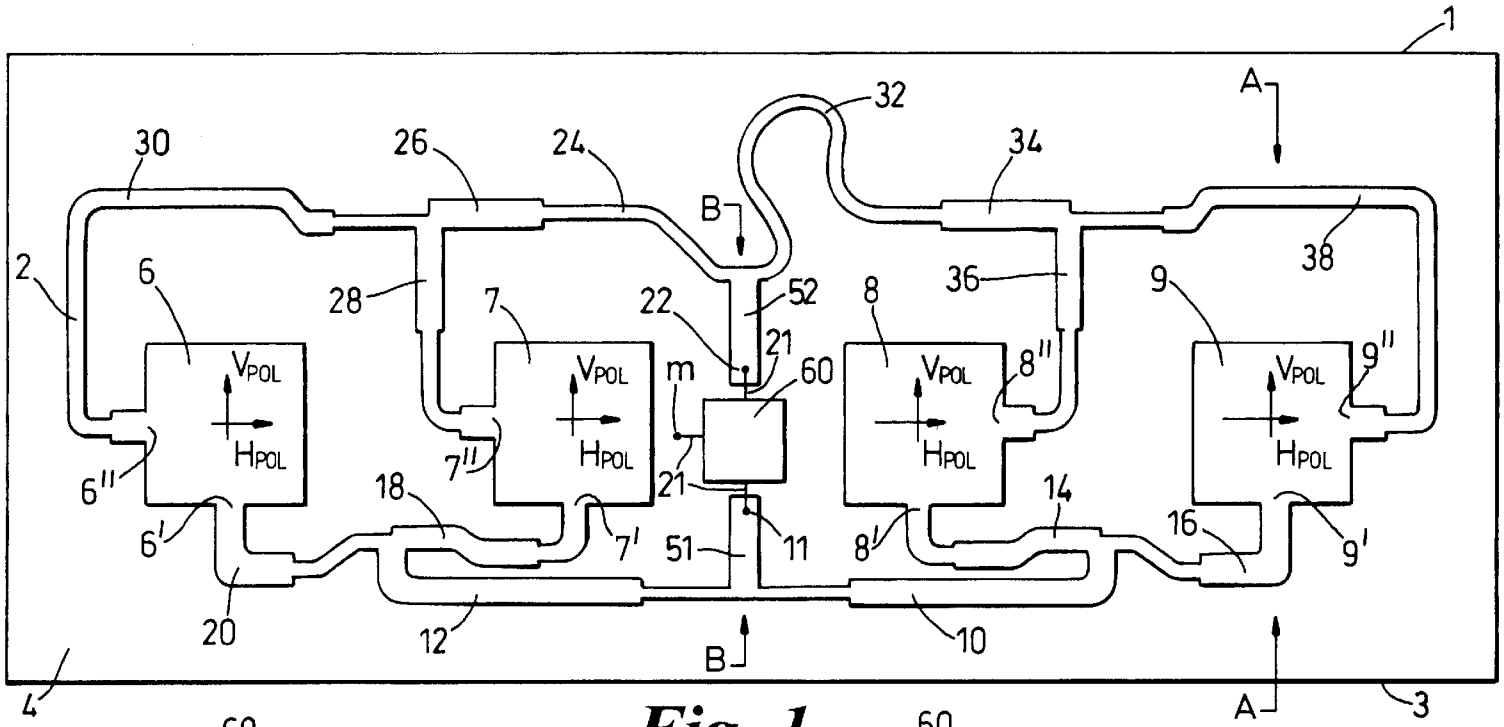
FIG. 1 shows a circuit of a patch antenna with feeder circuits according to the present invention.

The antenna (40) is mounted with its longer sides (1,3) substantially horizontal and so when the antenna is required to operate with vertically polarised RF radiation the circuit (2) is fed at feed point (11). The impedance matched microstrip feeder lines (10, 14, 16, 18, 20) transmit the electromagnetic signal input at feed point (11) so that it is split equally into four signals which arrive in phase with each other at vertical feed points (6',7',8',9') of the patches (6,7,8,9).

When the antenna is required to operate with horizontally polarised RF radiation the circuit (2) is fed at point (22). The impedance matched microstrip feeder lines (24, 26, 28, 30) transmit half of the electromagnetic signal input at feed point (22) so that it is split equally into two signals which arrive in phase at horizontal feed points (6",7") of the patches (6,7). Feeder lines (32,34,36,38) similarly transmit half of the electromagnetic signal input at feed point (22) so that it is split equally into two signals which arrive in phase at horizontal feed points (8", 9") of the patches (8,9). However, the feeder line (32) to patches (8) and (9) has a looped path which is L/2 longer than the equivalent feeder line to patches (6) and (7), where L is the average wavelength of signal for which the antenna (40) is designed to operate. The extra L/2 path length is included to compensate for the fact that patches (8) and (9) are fed from the opposite side (right hand side in FIG. 1) to patches (6) and (7) (which are fed from the left hand side in FIG. 1). This ensures that the patches (6,7,8,9) appear to operate in phase.

When a subscriber wishes to send a signal over the network, for example, a voice signal from the subscriber's telephone handset, the voice signal is transmitted to the transceiver circuitry (5) of the antenna (40) over, for example, a co-axial cable. The circuit board transceiver circuitry (5) modulates the voice signal onto a RF carrier wave and the modulated carrier is fed into the circuit (2). The modulated carrier signal for the circuit (2) is input via a four pole switch arrangement (60) shown in FIGS. 1, 2*a* and 2*b*.

Figure 2B:
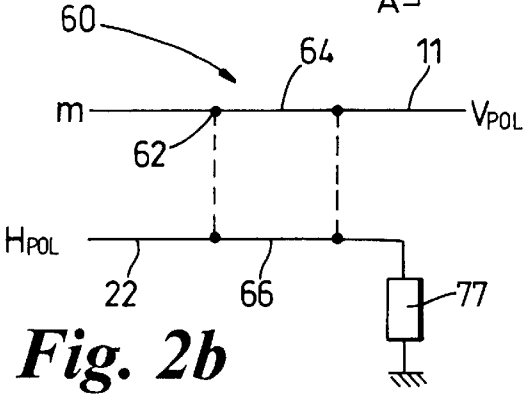
FIGS. 2*a* and 2*b* show a four pole switch suitable for switching the antenna circuit shown in FIG. 1 between vertical and horizontal polarisations.
Figure 2A:
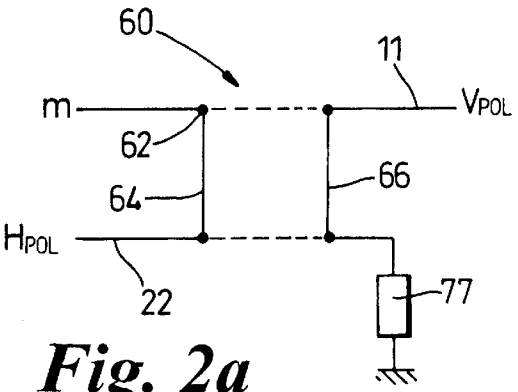

The switch (60) is mounted on the sheet (4) and is integrated into the feeder circuitry (2) by microstrip lines (21) which connect the terminals of the switch to feed pints (11) and (22) and to connection M. The switch (60) may be a four pole switch as shown in FIGS. 2*a* and 2*b* or may alternatively be a single pole, double throw switch (60') of the type shown in FIGS. 5*a* and 5*b* as described below. The switches (60,60') may be Gallium Arsenide based microwave integrated circuit switches which are available in chip form and are mounted on the plastic sheet (4) and connected to the feeder circuitry (2) by printed strips of copper.

Referring back to FIG. 2*a* which shows the switch (60) in the horizontal polarisation feed position, the modulated carrier signal (M) from the circuit board (5) arrives at the first pole (62) of the switch from which it is passed to feed point (22) due to the positioning of the first arm (64) of the switch. The input signal is thus transmitted to feed points (6",7",8",9") of the patches (6,7,8,9) and the modulated carrier wave is transmitted as horizontally polarised RF radiation. When the second arm (66) is in the horizontal polarisation position shown in FIG. 2*a* the feed point (11) is connected to a 50 ohm load (77). This terminates the feeder lines to the patches (6,7,8,9) in the vertical polarisation. Therefore, horizontally polarised RF radiation will be transmitted by the antenna at a predominantly higher gain than vertically polarised RF radiation. Furthermore, with the switch (60) in the position shown in FIG. 2*a*, the antenna (40) will receive predominantly horizontally polarised RF radiation. The signal received at the patches (6,7,8,9) is coupled to feed point (22) by the feeder lines and will be routed, via switch (60) to the RF transceiver circuitry on circuit board (5). The circuit board (5) processes the received signal coupled to it by the feeder lines in order to recover the modulation signal. The recovered signal is then transmitted, for example, if it is a voice signal to a subscribers telephone over a co-axial cable.

When the switch (60) is switched over to its vertical polarisation position shown in FIG. 2*b* the first arm (64) connects the first pole (62) to feed point (11) and so the modulated carrier signal (M) from the transceiver circuitry (5) is transmitted to feed points (6",7',8',9') of the patches (6,7,8,9) and vertically polarised RF radiation is transmitted. When the second arm (66) is in the vertical polarisation position shown in FIG. 2*b* the feed point (22) is connected to a 50 ohm load (77) which terminates the patches (6,7,8,9) in the horizontal polarisation. Therefore, vertically polarised RF radiation will be received by the antenna at a predominantly higher gain than horizontally polarised RF radiation.

Figure 5A:
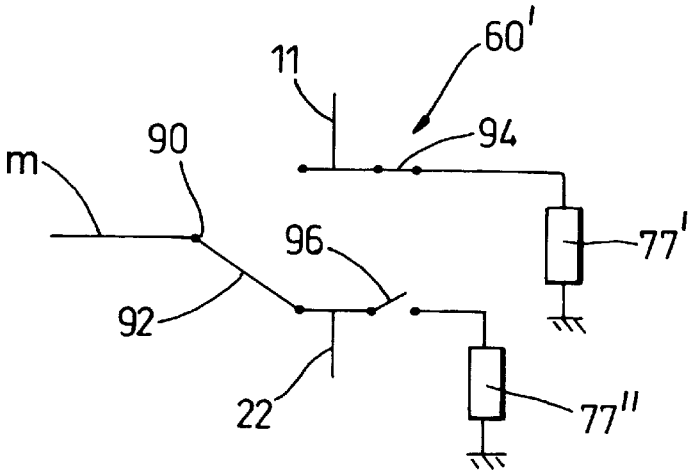
FIGS. 5*a* and 5*b* show a single pole double throw switch suitable for switching the antenna circuit shown in FIG. 1 between vertical and horizontal polarisations.
Figure 5B:
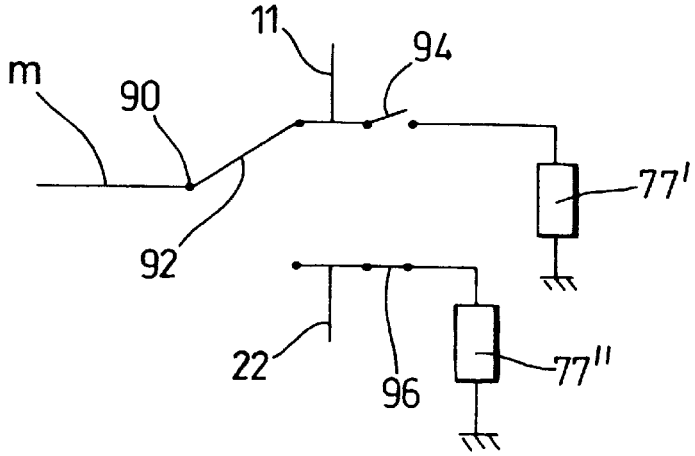

Referring now to FIGS. 5*a* and 5*b* which show a switch (60') which can be integrated into the feeder circuitry (2) as an alternative to the switch (60) of FIGS. 2*a* and 2*b*. The modulated carrier signal for the circuit (2) is alternatively input via a single pole, double throw switch arrangement (60') which may be a Gallium Arsenide based microwave integrated circuit switch available in chip form. This is then mounted onto the sheet of plastics material (4) and integrated into the feeder line circuitry (2), in the same way as is shown for the switch (60') in FIG. 1.

When the switch (60') is in its horizontal polarisation position, shown in FIG. 5*a*, the modulated carrier signal (M) from the circuit board (5) arrives at the first pole (90) of the switch (60') from which it is passed to the feed point (22) due to the positioning of the arm (92) of the switch. Also, in the horizontal polarisation position the load switch (94) is closed to connect the feed point (11) to a 50ohm load (77') and the load switch (96) is opened.

When the switch (60') is in its vertical polarisation position, shown in FIG. 5*b*, the modulated carrier signal (M) is passed from the first pole (90) of the switch (60') to the feed point (11) due to the positioning of the arm (92) of the switch. Also, in the vertical polarisation position the load switch (96) is closed to connect the feed point (22) to a 50 ohm load (77") and the load switch (94) is opened. The opening and closing of the switches (92,94,96) is controlled, by the integrated circuit within which the switches are located, in response to voltages applied to the integrated circuit.

Figure 6:
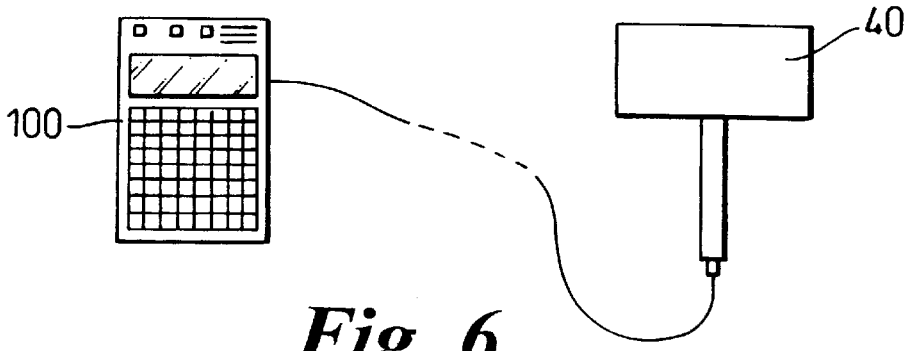
FIG. 6 shows a schematic representation of the antenna of FIG. 3 interfaced with a computing device.

The embodiment of the present invention described above is suitable for use in a signal assessment kit, shown in FIG. 6. This is used by a technician conducting surveys at a subscriber's premises in order to locate the best channel and best location for the subscriber unit's antenna. The portable computer (100) which forms part of the signal assessment kit and which includes a modem is programmed with information about which polarisation of radiation should be used in the subscriber's antenna unit at the addresses of different subscriber's premises. The portable computer (100) is connected via an interface unit to the dual polarisation antenna (40) and is arranged to switch the switch (60,60') to the correct position in response to the address of the subscriber being input or highlighted on the computer by the technician. Alternatively, the computer can display for the technician the correct polarisation of radiation to be used at the subscriber's premises and the technician will operate a switch lever located on the outside of the test antenna to change the position of the switch (60) so that the antenna works in the desired polarisation.

Figure 3:
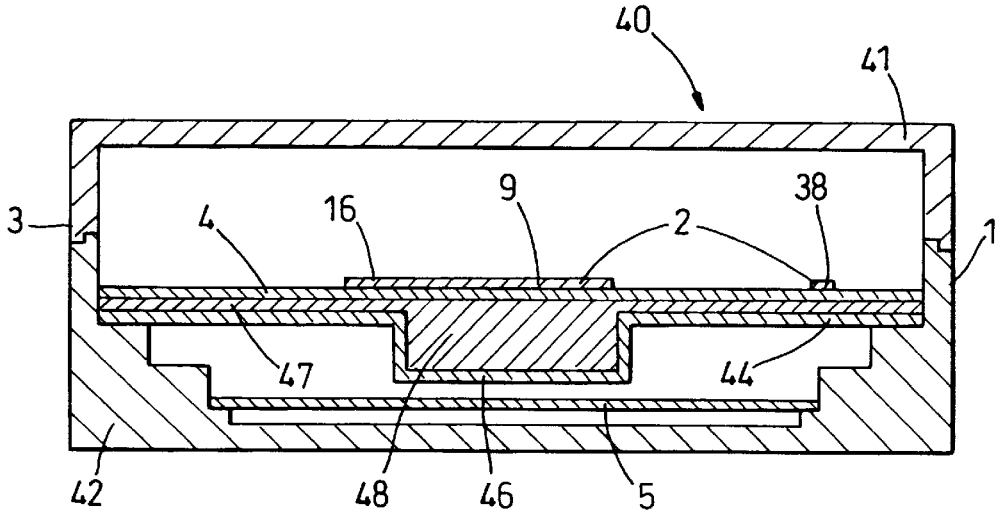
FIG. 3 shows a cross section through a first embodiment of a patch antenna incorporating the circuit of FIG. 1, along line AA of FIG. 1.
Figure 4:
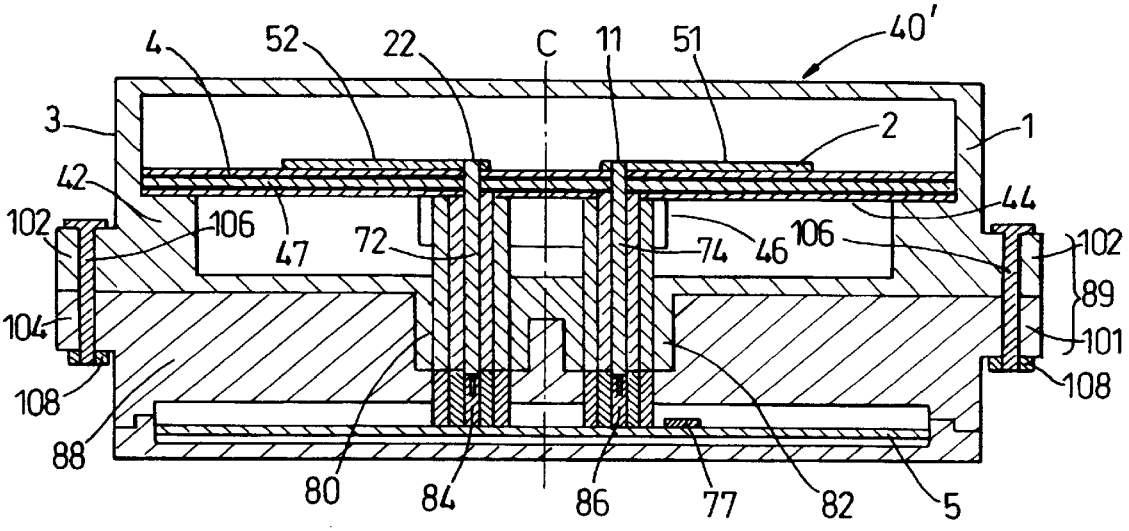
FIG. 4 shows a cross section through a second embodiment of a patch antenna incorporating the circuit of FIG. 1, along line BB of FIG. 1.

However, for antennas which are permanently located at a subscriber's premises the type of switching arrangement shown in FIG. 4 is preferred, because there is no switch loss and the cost is lower. FIG. 4 shows a cross section though an antenna (40') incorporating circuit (2) of FIG. 1, but without the switch (60) and feed point (M). The cross section is taken through line BB of FIG. 1. Accordingly, in FIG. 4, on the sheet of plastics material (4) can be seen the part of the circuit (2) comprising input feeder lines (51) and (52) and respective feed points (11) and (22) (the switch (60) and the connections from the switch (60) to the feed points (11) and (22) are not included in this embodiment). The sheet (4) is supported on a layer of dielectric material (47) which insulates the circuit (2) from the supporting backplate (44) as described above in relation to FIG. 3. The switching arrangement shown in FIG. 4 comprises two pairs of co-axial contacts; the antenna co-axial contacts (72,74) and the socket co-axial contacts (84,86). The co-axial contacts comprise lengths of co-axial cable comprising an inner conductor, an intermediate layer of insulating material, such as PTFE and an outer conductor. Antenna co-axial contact (72) comprises a length of co-axial cable from which the inner conductor extends at either end. One end of the inner conductor is electrically connected to feed point (22) and at the same end the outer conductor is electrically connected to the backplate (44). The co-axial contact (72) extends through the housing (42), supported and protected by contact housing (80). Similarly, antenna co-axial contact (74) is fixed to feed point (11) and backplate (44) and extends through the housing (42), supported and protected by contact housing (82).

The inner conductor of the socket co-axial contact (84) connects the transceiver circuitry (5) to the feeder and patch circuit (2) via one of the co-axial contacts (72,74) ((72) in FIG. 4). The inner conductor of the socket co-axial contact (86) is connected to a 50 ohm load (77) mounted on the transceiver circuit board (5). The outer conductors of the socket co-axial contacts (84,86) are connected to ground and so connect the outer conductors of the antenna co-axial contacts (72,74) and thus the backplate (44) to ground. Therefore, in FIG. 4 a modulated carrier signal generated by the transceiver circuitry (5) is input via co-axial contacts (84) and (72) to feeder point (22) so that the antenna predominantly transmits the modulated carrier signal as horizontally polarised radiation. The feeder point (11) is connected to a 50 ohm load (77) via co-axial contacts (74) and (86) which terminates the patches (6,7,8,9) in the vertical polarisation. Accordingly, the patches (6,7,8,9) receive predominantly horizontally polarised radiation which is coupled to the feeder point (22) by the feeder lines and passed to the transceiver circuitry via contacts (72,84).

The contact housings (80) and (82) form a plug which fits within a mating socket (88) in which are located the socket coaxial contacts (84) and (86). The plug (80,82) on the antenna housing can be fixed to the mating socket housing (88) by a releasable latch arrangement (not shown) or by a screw connection (89). The screw connection (89) comprises two pairs of lugs (102) and (104) formed in the antenna housing (42) and the socket housing (88) respectively. The lugs are formed with aligned holes through which are fitted fasteners (106) which have a screw threaded end onto which can be screwed a nut (108). The transceiver circuit board (5) is located within the socket housing (88). To change the arrangement shown in FIG. 4 to one in which the antenna (40) transmits and receives predominantly in the vertical polarisation the antenna housing (42) is removed from the socket housing (88) by releasing the screw connections (89) and pulling the plug (80,82) from the socket housing (88). Then the antenna housing (42) is rotated through 180° about an axis (C) and the plug (80,82) of the antenna housing (42) is reconnected in the socket housing (88) and the screw connections (89) are fixed. In this way the feed point (11) is connected to socket co-axial contact (84) via antenna co-axial contact (74) which connects the electromagnetic modulated signal output from the circuit board (5) to feed point (11) so that the antenna transmits and receives predominantly in the vertical polarisation. Also, the feed point (22) is connected to the 50 ohm load (77) via coaxial contacts (86) and (72).

Therefore, the polarity of the antenna according the second embodiment of the present invention can be changed by an installation technician disconnecting the front part of the antenna housing (42) from the socket housing (88) rotating it through 180° and reconnecting the front part of the antenna housing (42) to the socket housing. The socket housing (88) can, therefore, remain rigidly fixed to the outside of a subscrber's premises while the polarisation of the antenna arrangement (40') is changed.

We claim:

1. A radio frequency antenna arrangement for selective operation at orthogonal polarisations of electromagnetic radiation, comprising;

a first housing for housing;

at least one radiating element each having a vertical polarisation feed point and a horizontal polarisation feed point, a vertical feeder circuit for coupling a radio frequency modulated electromagnetic signal to the vertical polarisation feed point of the or each radiating element, and a horizontal feeder circuit for coupling a radio frequency modulated electromagnetic signal to the horizontal polarisation feed point of the or each radiating element, a second housing for housing;

a terminating resistive load, and a connection to the modulated electromagnetic signal, and a switch mechanism comprising a mechanically selectable electrical connection between the first housing and the second housing for selectively coupling the electromagnetic signal to one of the horizontal feeder circuit or the vertical feeder circuit and for selectively coupling the load to the other of the horizontal feeder circuit or the vertical feeder circuit.

2. An antenna arrangement according to claim 1 wherein;

the second housing has a first electrical contact coupled to the modulated electromagnetic signal and a second electrical contact connected to the resistive load, and the first housing has a third electrical contact connected to the horizontal feeder circuit and a fourth electrical contact connected to the vertical feeder circuit, such that in a first position of the switch mechanism the first and third contacts and second and fourth contacts are electrically connected and in a second position of the switch mechanism the first and fourth contacts and the second and third contacts are electrically connected.

3. An antenna arrangement according to claim 1 wherein the mechanically selectable electrical connection is changed by selective alignment of the first and second housings.

4. An antenna arrangement according to claim 1 wherein the mechanically selectable electrical connection is changed by selective alignment of the first and second housings and the alignment between the first and second housings is changed by a relative rotation of 180° between the two housings.

5. An antenna arrangement according to claim 1 wherein the second housing contains a modulation circuit for generating the radio frequency modulated electromagnetic signal as an output.

6. An antenna arrangement according to claim 1 wherein the radiating elements are antenna patches.

7. A radio frequency antenna arrangement for selective operation at orthogonal polarisations of electromagnetic radiation, comprising;

at least one radiating element each having a vertical polarisation feed point and a horizontal polarisation feed point, a vertical feeder circuit for coupling a radio frequency modulated electromagnetic signal to the vertical polarisation feed point of the or each radiating element, a horizontal feeder circuit for coupling a radio frequency modulated electromagnetic signal to the horizontal polarisation feed point of the or each radiating element, a terminating resistive load, and a switch mechanism which is integrated into the feeder circuits for selectively coupling the electromagnetic signal to one of the horizontal feeder circuit or the vertical feeder circuit and for selectively coupling the load to the other of the horizontal feeder circuit or the vertical feeder circuit.

8. An antenna arrangement according to claim 7 wherein the arrangement additionally comprises a modulation circuit for generating the radio frequency modulated electromagnetic signal as an output.

9. An antenna arrangement according to claim 7 wherein the switch mechanism comprises a four terminal electrical switch, including;

a first terminal coupled to the electromagnetic modulated signal, a second terminal coupled to the resistive load, a third terminal coupled to the horizontal feeder circuit, and a fourth terminal coupled to the vertical feeder circuit, so that in a first switch position the first terminal is connected to the third terminal and the second terminal is connected to the fourth terminal and in a second switch position the first terminal is connected to the fourth terminal and the second terminal is connected to the third terminal.

10. An antenna arrangement according to claim 7 wherein the switch mechanism comprises;

a first terminal coupled to the electromagnetic modulated signal, a second terminal coupled to the horizontal feeder circuit, a third terminal coupled to the vertical feeder circuit, and a load switch circuit, so that in a first switch position the first terminal is connected to the second terminal and the third terminal is connected to a terminating resistive load by the load switch circuit and in a second switch position the first terminal is connected to the third terminal and the second terminal is connected to a terminating resistive load by the load switch circuit.

11. An antenna arrangement according to claim 7 wherein the antenna arrangement is housed in a single antenna housing.

12. An antenna arrangement according to claim 7 wherein the radiating elements are microstrip antenna patches.

13. An arrangement according to claim 7 wherein the switch mechanism is interfaced with a computing device which operates the switch mechanism.

14. A method for switching the polarisation of an antenna arrangement between two orthogonal polarisations, which antenna arrangement comprises;

a first housing for housing;

at least one radiating element each having a vertical polarisation feed point and a horizontal polarisation feed point, a vertical feeder circuit for coupling a radio frequency modulated electromagnetic signal to the vertical polarisation feed point of the or each radiating element, and a horizontal feeder circuit for coupling a radio frequency modulated electromagnetic signal to the horizontal polarisation feed point of the or each radiating element, a second housing for housing;

a terminating resistive load, and a connection to the modulated electromagnetic signal, and said method comprising the steps of;

mechanically selecting an electrical connection between the first housing and the second housing for selectively coupling the electromagnetic signal to one of the horizontal feeder circuit or the vertical feeder circuit and for selectively coupling the load to the other of the horizontal feeder circuit or the vertical feeder circuit.

15. A method according to claim 14 wherein mechanically selecting an electrical connection between the first and second housing comprises the step of selectively aligning the first and second housings.

16. A method according to claim 14 wherein mechanically selecting an electrical connection between the first and second housing comprises the step of rotating one of the first or second housings relative to the other by 180°.

* * * * *